United States Patent [19]

Uozumi

[11] Patent Number: 4,484,526

[45] Date of Patent: Nov. 27, 1984

[54] SWITCHING MEANS FOR GUIDEWAY TRACKS

[75] Inventor: Yukio Uozumi, Kobe, Japan

[73] Assignee: Kawasaki Jukogyo Kabushiki Kaisha, Kobe, Japan

[21] Appl. No.: 377,855

[22] Filed: May 13, 1982

[30] Foreign Application Priority Data

May 13, 1981 [JP] Japan ..... 56-72717

[51] Int. Cl.[3] ..... E01B 7/08

[52] U.S. Cl. ..... 104/131; 246/433

[58] Field of Search ..... 104/130, 131, 245, 247, 104/96, 100; 246/422 A, 433

[56] References Cited

U.S. PATENT DOCUMENTS

| | | | |
|---|---|---|---|
| 330,878 | 11/1885 | Duggan | 246/433 |
| 3,661,091 | 5/1972 | Noble | 104/130 |
| 3,791,306 | 12/1974 | Wagner et al. | 104/130 |
| 4,215,837 | 8/1980 | Uozumi et al. | 104/130 |

FOREIGN PATENT DOCUMENTS

| | | | |
|---|---|---|---|
| 47-43123 | 12/1972 | Japan | 104/130 |
| 48-8328 | 3/1973 | Japan | 104/130 |
| 4236246 | 5/1973 | Japan | 104/130 |
| 54-51107 | 4/1979 | Japan . | |
| 54-97906 | 8/1979 | Japan | 104/130 |
| 55-55281 | 12/1980 | Japan | 104/130 |

*Primary Examiner*—David A. Scherbel
*Assistant Examiner*—Donald T. Hajec
*Attorney, Agent, or Firm*—Kerkam, Stowell, Kondracki & Clarke

[57] ABSTRACT

A switching structure for a guideway track including one or more running ways adapted for supporting running wheels of a guideway vehicle and one or more guide rails adapted for guiding guide wheels of the vehicle. The switching structure includes a first and second substantially vertically movable guide rails, a crank mechanism for alternately raising and lowering the first and second movable guide rails for switching running path of the vehicle and a driving device for driving the crank mechanism. The crank mechanism has a first and second crankarms having a phase difference smaller than 180°, the first movable guide rail being connected with the first crankarm at a first radius position so that the first movable guide rail is movable substantially vertically for a first stroke when the first crankarm is rotated in an angular range which extends from a horizontal line upwardly by a first upward angle and downwardly by a first downward angle, the second movable guide rail being connected with the second crankarm at a second radius position so that the second movable guide rail is movable substantially vertically for a second stroke when the second crankarm is rotated in an angular range which extends from a horizontal line upwardly by a second upward angle and downwardly by a second downward angle. The first and second strokes satisfying a specific relationship, with respect to the radius, the upward and downward angles so that the operation and the structure of the switching device can be simplified.

9 Claims, 16 Drawing Figures

SWITCHING MEANS FOR GUIDEWAY TRACKS

The present invention relates guide tracks which have horizontal running ways and guide rails provided with vertical guide surfaces so as to support vehicles having rubber tired running wheels adapted to run on the running way and guide wheels adapted to run on the guide surfaces of the guide tracks. More particularly the present invention pertains to a switching or turnout device for such guide tracks.

In general, guide tracks having running ways and guide rails have to be provided with specially designed switching or turnout devices in order to avoid interference between the guide rails. In one type of turnout devices, the guide rails in two merging lines are alternately raised and lowered at the merging area so that only the guide rails in one line are in the raised operation position while the others are lowered so that they do not interfere with the truck and the vehicle body passing through the merging area. This type of turnout device is advantageous in that it does not require a substantial area in addition to that required for providing normal guide tracks, however, simple vertical movements of the guide rails produce possibilities of interference between two adjacent guide rails. In order to solve the problem, Japanese utility model publication No.48-15690 proposes to move one of the guide rails after the other has been completely shifted. The proposed structure is however inconvenient because two steps are required in completing the switching operation. Other proposals have also been made by Japanese utility model publication Nos. 47-43123, 48-8328 and 55-55281, Japanese patent disclosures Nos. 54-51107 and 54-97906 and the U.S. Pat. No. 4,215,837, however, these proposals have either the same problems as discussed above, complicated in structure or impossible to apply to a track having a guide rail between a pair of parallel running ways.

It is therefore an object of the present invention to provide a switching or turnout device for a guideway track structure which is simple and quick in operation and has less movable parts so that the power and time required for switching can be significantly shortened.

Another object of the present invention is to provide a switching structure which can be readily applied to either a guide track having a pair of guide rails at the opposite sides of running way means or a guide track having a guide rail between a pair of running ways.

A further object of the present invention is to provide a switching or turnout structure which can be applied readily to a crossing between tracks.

Still further object of the present invention is to provide a switching structure for a guideway track in which one or more driving motors can arbitrarily be used for operating one switching structure.

A further object of the present invention is to provide a switching structure for a guideway track in which switching operation can readily be controlled.

Still further object of the present invention is to provide a temperature-stable switching structure for a guideway track.

Still further object of the present invention is to provide a switching structure for a guideway track in which a smooth junction can be provided between a movable and stationary guide rails.

According to the present invention, the above and other objects can be accomplished by a switching structure for a guideway track including running way means adapted for supporting running wheels of a guideway vehicle and guide rail means adapted for guiding guide wheels of said vehicle, said switching structure including a first and second substantially vertically movable guide rail means, crank means for alternately raising and lowering the first and second movable guide rail means for switching running path of the vehicle, driving means for driving the crank means, said crank means having a first and second crankarms having a phase difference smaller than 180°, said first movable guide rail means being connected with said first crankarm at a first radius position so that the first movable guide rail means is movable substantially vertically for a first stroke when the first crankarm is rotated in an angular range which extends from a horizontal line upwardly by a first upward angle and downwardly by a first downward angle, said second movable guide rail means being connected with said second crankarm at a second radius position so that the second movable guide rail means is movable substantially vertically for a second stroke when the second crankarm is rotated in an angular range which extends from a horizontal line upwardly by a second upward angle and downwardly by a second downward angle, said first and second strokes satisfying the following relationship.

$$ha = ra(\sin \beta a + \sin \gamma a)$$

$$hb = rb(\sin \beta b + \sin \gamma b)$$

where:

ha and hb are the first and second strokes, respectively;

ra and rb are the first and second radius, respectively;

$\beta$a and $\beta$b are the first and second upward angles; and;

$\gamma$a and $\gamma$b are the first and second downward angles, said first and second movable guide rail means being shifted during their downward strokes horizontally by distances a and b, respectively, wherein the following relationships are established;

$$\delta a = ra(\cos \beta a - \cos \gamma a)$$

$$\delta b = rb(\cos \beta b - \cos \gamma a).$$

The crank means may include at least two crankshafts which are disposed in parallel with each other. The crankshafts may be located substantially in alignment with normal lines with respect to centers of movements of the movable guide rail means. The crankshafts may be connected through connecting link means with each other so that they are synchronously operated. In connecting the crankarms to the movable guide rail means, one of the crankarms may be connected directly with one of the guide rail means and the other crankarm with the other guide rail means through substantially vertical link means or substantially horizontally movable slide block means. Alternatively, both of the crankarms may be connected with respective ones of the guide rail means through substantially horizontally movable slide block means, one of the slide block means being movable by a smaller distance than the other.

The other and other objects and features of the present invention will become apparent from the following descriptions of preferred embodiments taking reference to the accompanying drawings in which.

Figure 1:
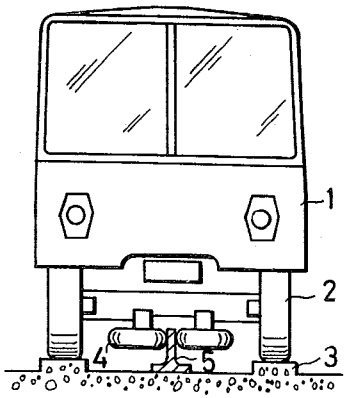
FIGS. 1 through 3 show different types of guideway vehicles and tracks therefor to which the present invention can be applied.
Figure 2:
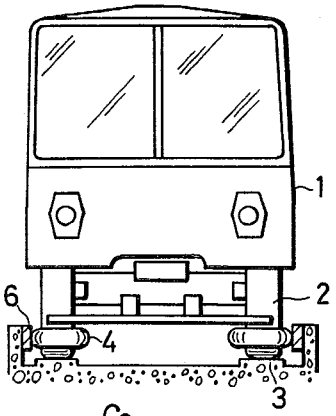
Figure 3:
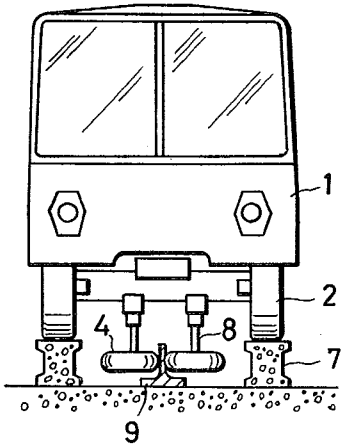

Referring first to FIGS. 1, 2 and 3, there are shown three types of known guide track arrangement and vehicles running along the respective guide track arrangement. In FIG. 1, a car body 1 is supported on running ways 3 by running wheels 2 such as rubber tires so that the wheels 2 roll along the running ways 3. The car body 1 includes horizontal guide wheels 4 which engage with a guide rail 5 at the vertical sides thereof to guide the vehicle. The guide rail 5 is located on the center of the guide track and extends beyond a plane including the tops of the running ways 3.

In FIG. 2, guide rails 6 are disposed outside of the running way 3 along the path of running wheels 2 with the vertical guide surfaces thereof faced inside. The vehicle has horizontal guide wheels 4 engaging with the guide surface of the guide rails.

In FIG. 3, a guide track includes running ways 7 having a height larger than those of the running ways aforementioned. The vehicle includes horizontal guide wheels 4 which are mounted on axles 8 extending below a plane including the tops of the running ways 7, respectively. The guide wheels 4 is positioned at a level lower than the tops of the running ways 7 and engage with the sides of a guide rail 9 which is located on the center of the guide track below the top faces of the running ways.

Figure 4:
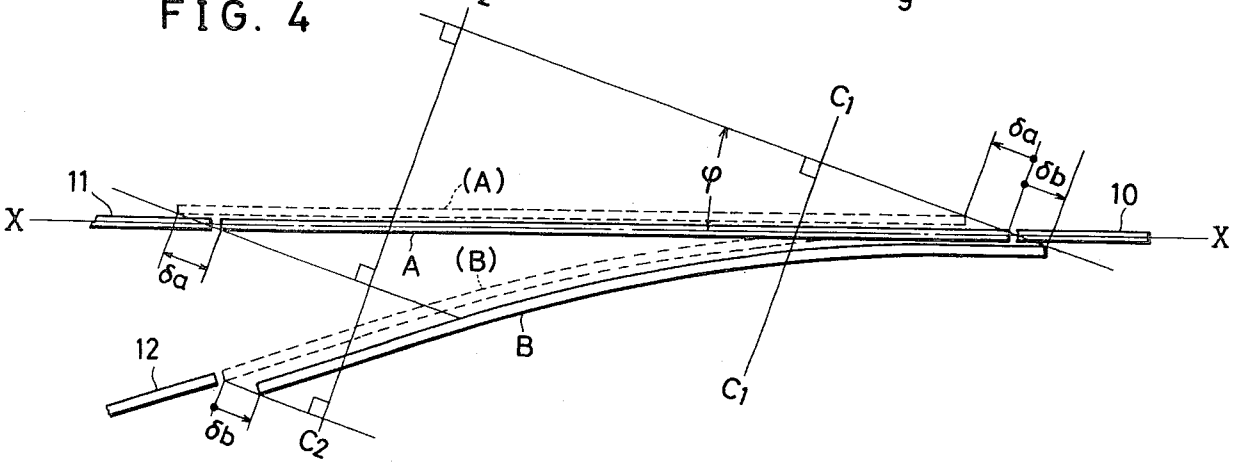
FIG. 4 is a plan view showing one embodiment of the present invention.

FIG. 4 shows an embodiment according to the present invention which can be applied to the guide track and vehicle shown in FIG. 1, and illustrates the linear movement of movable guide rails, reference numerals 10, 11 and 12 designate stationary guide rails which are disposed adjacent to the movable guide rail and arranged on the center of the guide track. Reference symbol A denotes a movable linear-type guide rail which is shown in a lifted position by solid line and connects with the stationary guide rails 10 and 11 in such a lifted position. When the movable guide rail A is lowered, it is moved linearly to a position shown by broken line (A) in the direction of angle $\phi$ relative to X—X axis by a distance $\delta a$ as shown by an arrow. Reference symbol B designates a movable curved guide rail which can be moved linearly between a lowered position shown by solid line and a lifted position (B) shown by solid line, in the direction of angle $\phi$ relative to X—X axis by a distance $\delta b$ as shown by an arrow. The movable guide rail A is lowered while at the same time the movable guide rail B is lifted to the position (B) to connect with the stationary guide rails 10 and 12. In FIG. 4, straight lines $C_1$–$C_1$ and $C_2$–$C_2$ represent the center lines of crank shafts disposed in the guide track and extend at right angle relative to the linear movement of the respective movable guide rail. By disposing the crank shafts in such an angular relationship, the movable guide rails can be moved linearly in the direction of angle $\phi$ under the action of crank arms which will be described hereinafter.

Figure 5:
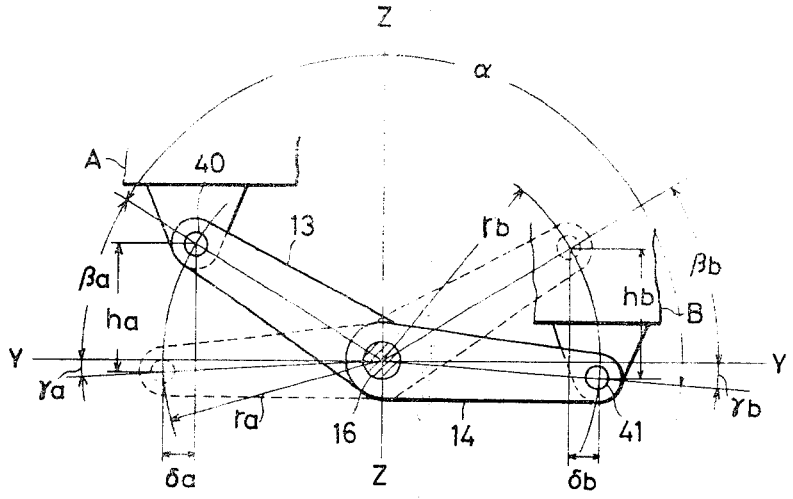
FIG. 5 is a side view showing the operation of the crank mechanism for driving the movable guide rail.

FIG. 5 illustrates the action of the above crank arms and shows a horizontal line Y—Y and a vertical line Z—Z. A crank shaft 16 has its center located at the intersection between the horizontal and vertical lines which corresponds to the straight line $C_1$–$C_1$ or $C_2$–$C_2$ in FIG. 4. Crank arms 13 and 14 are fixedly mounted on the crank shaft 16 and angularly spaced away from each other with a phase angle $\alpha$ less than 180°. The other end of the crank arm 13 is provided with a crank pin 40 which has a center located at the radius ra from the center of the crank shaft and on which the movable guide rail A is pivotally mounted. The other end of the crank arm 14 also includes a crank pin 41 which has a center located at the radius rb from the center of crank shaft and on which the movable guide rail B is pivotally mounted. In FIG. 5, the crank arms are positioned in the respective locations shown by solid lines when the movable guide rail A is lifted while the movable guide rail B is lowered. When the movable guide rails are shifted to the reversed relation therebetween, the crank arms are located in the respective positions shown by broken lines.

In FIG. 5, where the respective vertical strokes of the movable guide rails A, B are ha, hb; the respective on-lifting-angles of the crank arms 13, 14 are $\beta$a, $\beta$b; and the respective on-lowering-angles of the crank arms are $\gamma$a, $\gamma$b, the relationships between the vertical strokes of the movable guide rails A, B and the crank angles, as can seen from FIG. 5, are given by the following equations:

$$ha = ra(\sin \beta a + \sin \gamma a), \text{ and}$$

$$hb = rb(\sin \beta b + \sin \gamma b).$$

The respective linear movements of the lowered movable guide rails A and B are given by the following equations:

$$\delta a = ra(\cos \beta a - \cos \gamma a), \text{ and}$$

$$\delta b = rb(\cos \beta b - \cos \gamma b).$$

The setting is so effected that the linear movements $\delta$a and $\delta$b are positive and that the movable guide rails are moved away from the vertical line Z—Z when they are lowered. From these equations, it would easily be understood that the movable guide rails are linearly moved in the respectively direction of angle $\phi$ by distance $\delta$a and $\delta$b when they are lowered.

Figure 6:
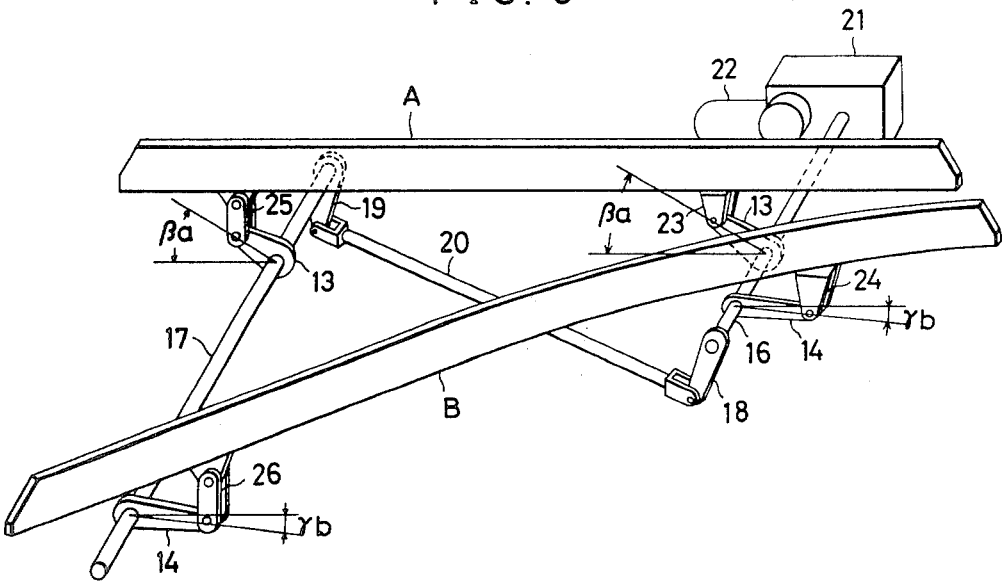
FIG. 6 is a perspective view showing the switching or turnout structure in accordance with the embodiment of the present invention shown in FIG. 4.

FIG. 6 is a perspective view showing one embodiment of the present invention which is applied to the guide track and vehicle shown in FIG. 1. In FIG. 6, the movable guide rail A is in its lifted position, and the crank arm 13 is positioned at an angle $\delta$a. On the other hand, the movable guide rail B is in its lowered position, and the crank arm 14 is positioned at an angle $\gamma$b. The crank shaft 16 includes a depending crank arm 18 which is connected with the depending crank arm 19 of another crank shaft 17 through a connecting rod 20. Thus, the crank arms 18 and 19 are rotated substantially through the same angle. Reference numeral 21 denotes a drive means including an electric motor 22 for rotating the crank shaft 16 by an angle ($\beta a+\gamma a$). The crank arms 13 and 14 are mounted on the same shaft and therefore rotated through the same angle at once. Consequently, there is given the following equation:

$$(\beta a+\gamma a)=(\beta b+\gamma b).$$

When the crank shaft 16 is driven to rotate, the crank shaft 17 is rotationally driven in synchronism with the rotation of the crank shaft 16 through the connecting rod 20.

The crank arms 13 and 14 on the crank shaft 16 are respectively connected with the respective movable guide rails A and B through brackets 23 and 24 so that the movable guide rails will be moved linearly at the same time as they are lifted or lowered. On the other hand, the crank arms 13 and 14 on the crank shaft 17 are respectively connected to the respective movable guide rails A and B through links 25 and 26 which extend substantially vertically. Thus, the rotation of the crank shaft 17 contributes to only the vertical movement of the movable guide rails. When the movable guide rails are deformed under thermal expansion, the deformation is taken up by the slight swing of the links 25 and 26 without any undue affection.

Figure 7:
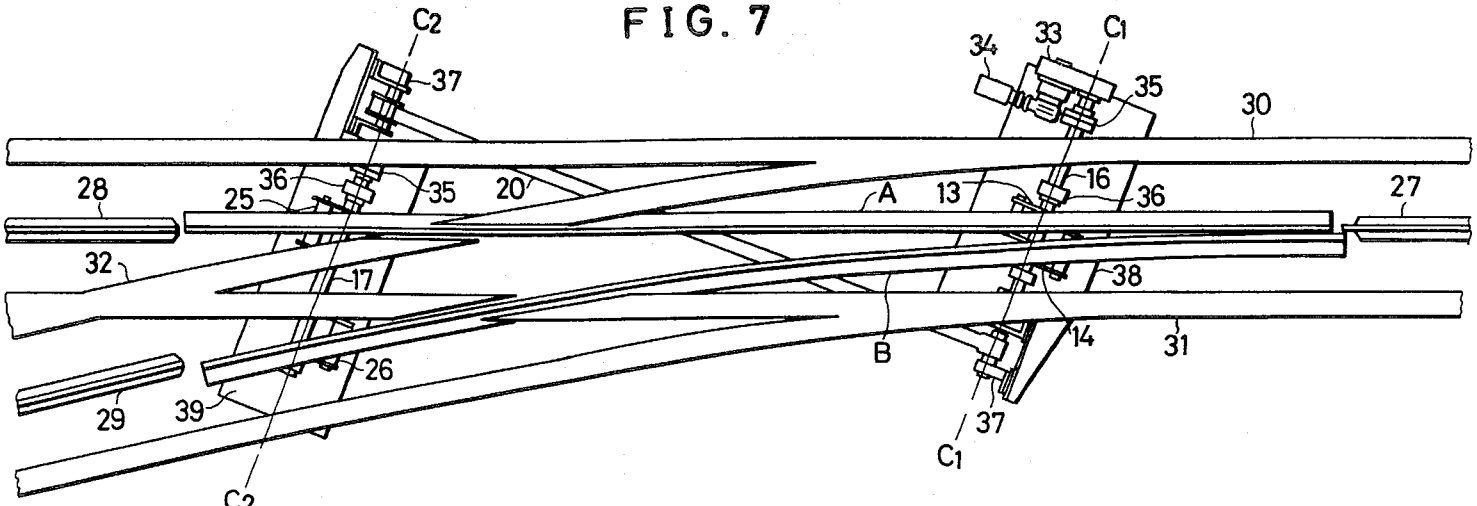
FIG. 7 is a plan view of the structure shown in FIG. 6.

FIG. 7 is a plan view of the entire turnout according to the present invention which is applied to the guide track and vehicle shown in FIG. 1. In this figure, the movable guide rail A is in its lifted position in which it is aligned with the stationary guide rails 27 and 28. On the other hand, the movable guide rail B is in its lowered position in which it is offset from the stationary guide rails 27 and 29. Reference numerals 30, 31 and 32 designate straight and curved running ways, respectively. Reference numeral 33 denotes a drive means including an electric motor 34 which serves to rotate the crank shaft 16 through a coupling 35. The crank shaft 16 is supported on a bed 38 by means of bearings 36 and 37. The crank shaft 17 is simultaneously rotated by the rotation of the crank shaft 16 through the connecting rod 20. The crank shaft 17 is supported on a bed 39 by means of bearings 36 and 37.

The crank arms 13 and 14 of the crank shaft 16 are pivotally mounted directly on the movable guide rails A and B, respectively. The crank arms 13 and 14 on the crank shaft 17 are connected with the respective movable guide rails A and B through the links 25 and 26, respectively.

Figure 9:
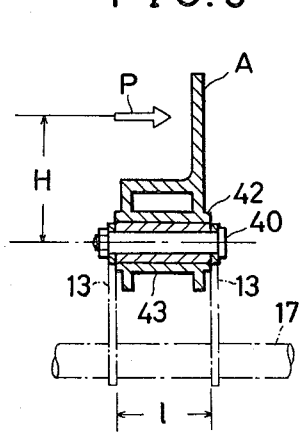
FIG. 9 is a sectional view taken along the line IX—IX in FIG. 8.
Figure 8:
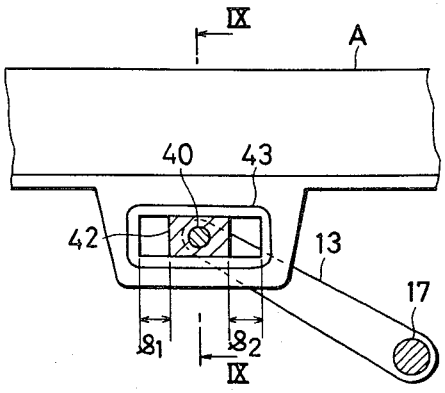
FIG. 8 is a side view of a guide rail driving device in accordance with another embodiment of the present invention.

FIGS. 8 and 9 show such an embodiment of the present invention that the crank pin 40 on the outer end of the crank arm 13 is connected with the movable guide rail A through a slide block. The slide block 42 is pivotally connected with the crank arm 13 through the crank pin 40 and disposed within a frame 43. Thus, the slide block 42 is connected with the movable guide rail A with only a linear movement provided therebetween in a vertical plane. Distance through which the slide block can move is shown by $s_1$ and $s_2$ in FIG. 8. This distance is set to be sufficiently large at such a place that thermal expansion is permissible. At such a place that thermal expansion is not permissible in one movable guide rail, the slide block is pivotally connected directly with said bracket 23 (FIG. 6) or otherwise the above distance is reduced up to 1–2 m/m at the right or left side of the slide block. This distance is smaller than gap da or db, about 5 m/m, which will be described with reference to FIGS. 14 and 15. Thus, the linear movement can be provided as shown by $\delta a$. As shown in FIG. 9, the slide block 42 and frame 43 are of a width 1 which is sufficient to resist a moment pH produced when a lateral load P required to guide the vehicle acts on a portion of the guide rail A which has a height H from the crank pin 40.

Figure 10:
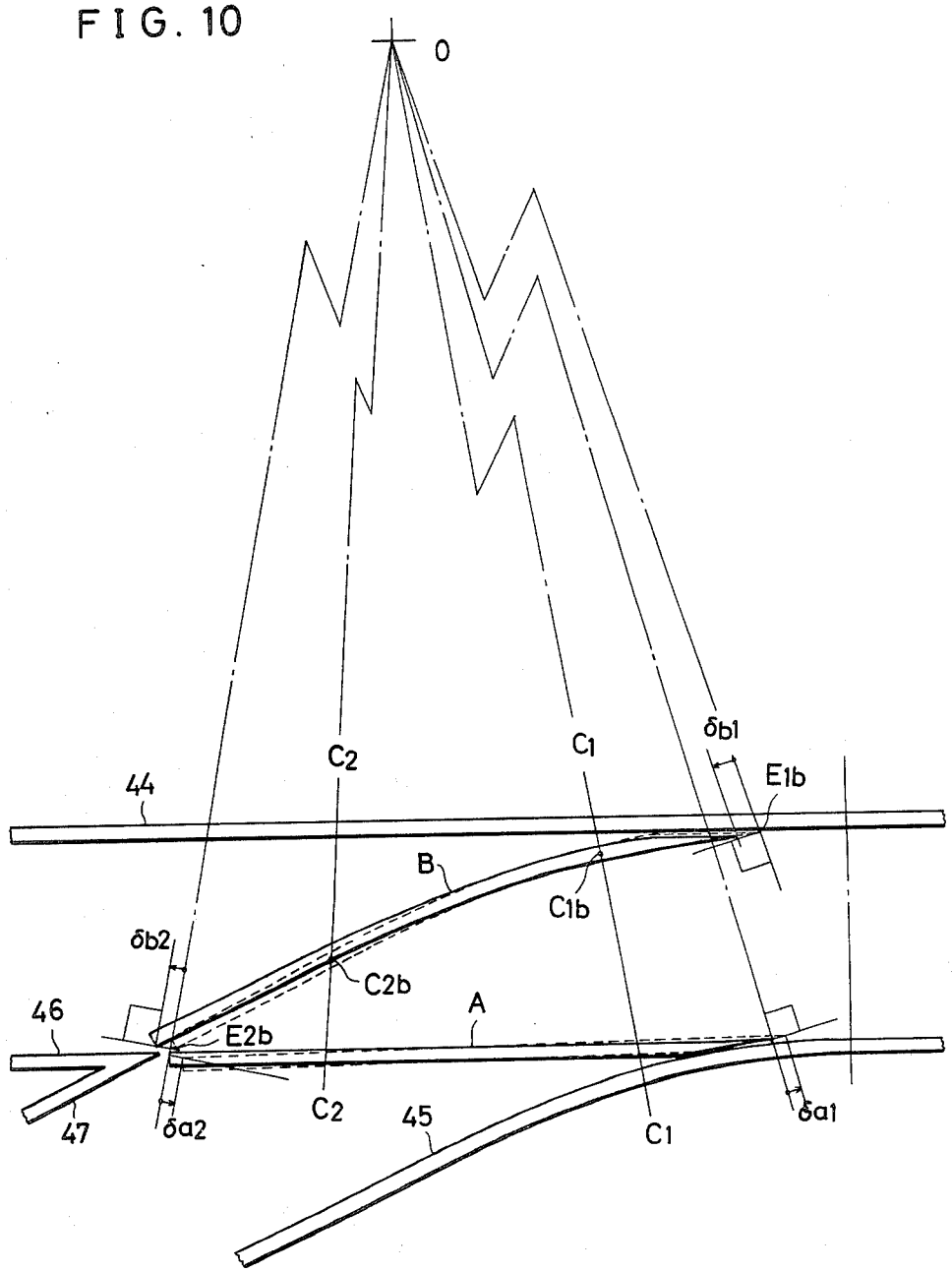
FIGS. 10 and 11 are plan views showing further embodiments of the present invention.

FIG. 10 shows a turnout arrangement which can be applied to the guide track and vehicle shown in FIG. 2. The movable guide rails A and B are respectively moved away from the stationary guide rails 44, 45, 46 and 47 when they are lowered. Thus, the movable guide rails can smoothly be actuated without any friction, for example, when there is a contact due to error in dimension. For this purpose, each of the movable guide rails is entirely shifted linearly through a larger radius. The radius has a center located at a remote point 0. The crank shafts are arranged to have central axes aligned with lines $C_1$–$C_1$ and $C_2$–$C_2$ on normal lines from the point 0, respectively. In such a manner, the movement of point $C_{1b}$ on the movable guide rail B directed at 90° relative to a line connecting the point 0 with the point $C_{1b}$, under the action of crank arms. The movement of point $C_{2b}$ on the same movable guide rail is similarly directed at 90° relative to a line connecting the point 0 with the point $C_{2b}$, under the action of crank arms. This is because the movable guide rail B is rotated about the point 0. Each point $E_{1b}$ or $E_{2b}$ on the movable guide rail B is moved by the amount of motion $\delta_{b1}$ or $\delta_{b2}$ proportional to the respective radius in the angular direction of 90° relative to a line connecting the point 0 with the point $E_{1b}$ or $E_{2b}$. This means that the movable guide rail B is moved from its lifted position shown by broken line to its lowered position shown by solid line. At this time, the point $E_{1b}$ is moved away from the stationary guide rail 44 while the point $E_{2b}$ is shifted away from the stationary guide rail 46. The movable guide rail A also is moved from its lowered position shown by broken line to its lifted position shown by solid line in the similar manner.

Figure 11:
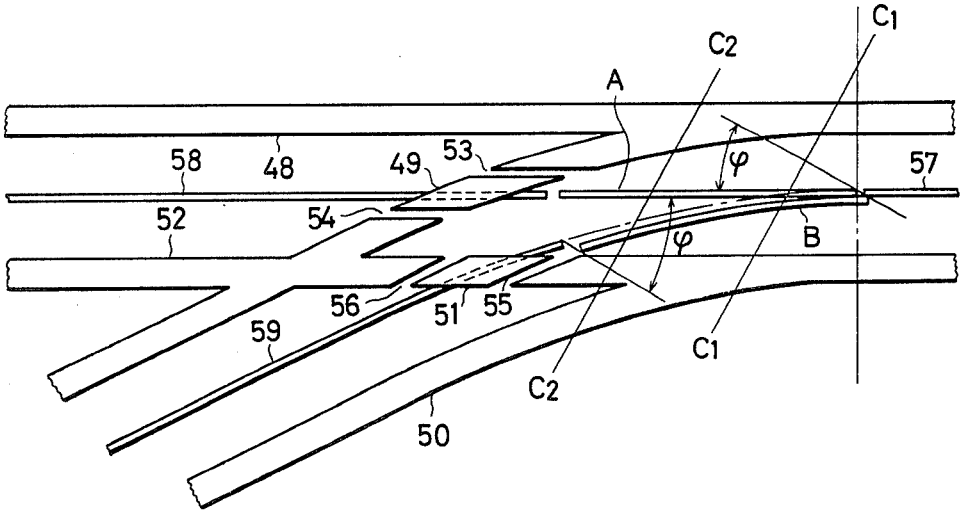

FIG. 11 shows a turnout arrangement which can be applied to the guide track and vehicle shown in FIG. 3. Reference numerals 48, 49, 50, 51 and 52 designate running ways which are respectively provided with slits 53, 54, 55 and 56 for permitting the guide wheel axle 8 of FIG. 3 to pass therethrough. Reference numerals 57, 58 and 59 denote stationary guide rails disposed at the center of the track and at a level below the running way surface. The crank shafts are located to align with the respective line $C_1$–$C_1$ and $C_2$–$C_2$. The movable guide rails are linearly moved in the direction of angle $\phi$. In the illustrated state, the movable guide rail A is lifted to align with the stationary guide rails 57, 58 while the movable guide rail B is lowered and linearly moved away from the movable guide rail A in the direction of angle $\phi$ relative to the lifted position of the movable guide rail B. Upon lowering, the movable guide rail A is linearly moved away from the movable guide rail B in the direction of angle $\phi$. At the same time, the movable guide rail B is lifted and linearly moved to align with the stationary guide rails 57 and 59. In such a manner, the movable guide rails can more smoothly be moved linearly by the above connection between the crank arms and the movable guide rails through the slide block shown in FIGS. 8 and 9 without any undue affection.

Figure 12:
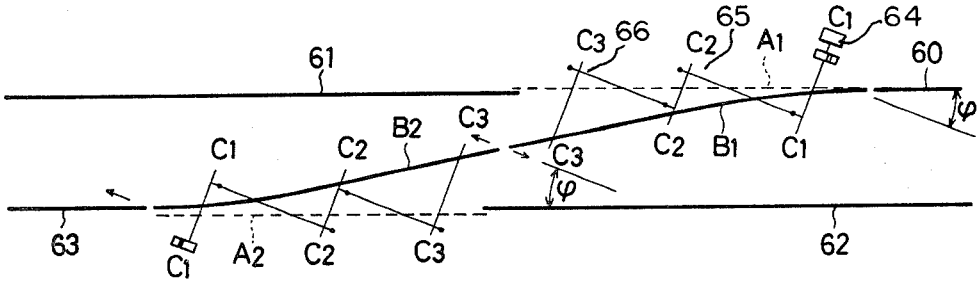
FIGS. 12 and 13 are diagrammatical views showing further embodiments.

FIG. 12 illustrates an example in which two turnout arrangements according to the present invention are applied to the scissors crossover of a double track. 60, 61, 62 and 63 are stationary guide rails which are disposed at the center of the track. In this figure, the movable guide rails $B_1$ and $B_2$ are lifted to align with stationary guide rails 60 and 63 for crossing. At this time, movable guide rails $A_1$ and $A_2$ are lowered and linearly moved to a position shown by broken line. In each of the turnout arrangement, the first, second and third crank shafts are provided at positions shown by $C_1$–$C_1$, $C_2$–$C_2$ and $C_3$–$C_3$, respectively. The first crank shaft is connected with a drive means 64 including an electric motor. The first crank shaft is connected with the second crank shaft through a connecting rod 65 while the second crank shaft is connected with the third crank shaft through a connecting rod 66. Thus, the rotation of the first crank shaft causes the second and third crank shafts in a synchronous relationship therebetween. While any mechanical linkage is not provided between two turnout arrangements, these turnout arrangements can electrically be controlled to operate substantially in synchronism with each other. When the movable guide rails $A_1$ and $A_2$ are lifted, the double track rails are opened with the scissors crossover being shut off. Upon lowering, the movable guide rails $B_1$ and $B_2$ are linearly moved away from each other in the direction of angle $\phi$. Upon lifting, they are linearly moved close to each other without any contact. Therefore, there is no obstruction even if the movable guide rails are not moved in synchronism with each other. In this regard, consequently, any specific turnout arrangements are not required in the scissors crossover which can be formed only by combining two turnout arrangements according to the present invention.

Figure 13:
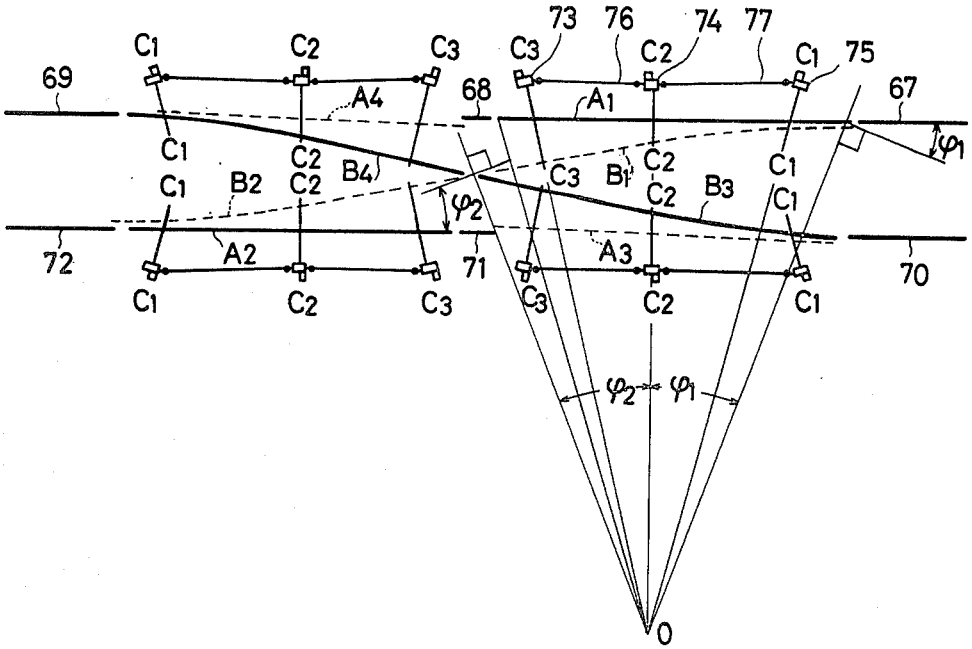

FIG. 13 shows an example in which four turnout arrangements according to the present invention are used to form a scissors crossover in a double track. The prior arts relating to the scissors crossover in a guide track are disclosed, for example, in Japanese Utility Model Publication No. 48-08328, "A split switch in a guide track" or Japanese Laid-Open Patent Application No. 54-97906, "A scissors cross-over in a guide track". In these prior arts, the guide rails are horizontally rotated in the crossing point by the use of four turnout arrangements well known and horizontal rotation device. According to the present invention, such a horizontal rotation device can be omitted so that a simple construction will more rapidly be operated with more simple work sequence. In FIG. 13, 67, 68, 69, 70, 71 and 72 are stationary guide rails which are located on the center of the track. Movable guide rails $A_1$, $A_2$, $B_3$ and $B_4$ are shown in their lifted positions to form a so-called right-hand scissors crossover as shown by 69-$B_4$-$B_3$-70. Movable guide rails $B_1$ and $B_2$ are shown in their lowered positions. The movable guide rail $B_1$ is linearly moved in such a direction that the right end thereof is moved away from the movable guide rail $A_1$ with an angle $\phi_1$ while at the same time the left end of this guide rail is moved away from the movable guide rails $B_3$ and $B_4$ with an angle $\phi_2$. The movable guide rails $B_2$, $B_3$ and $B_4$ are linearly moved in the same manner as in the movable guide rail $B_1$ when they are lowered. Accordingly, these movable guide rails will not interfere with each other so that there is no obstruction on lowering and lifting. The pair of movable guide rails $B_1$, $B_2$ or $B_3$, $B_4$ are aligned with the corresponding stationary guide rails when the movable guide rails are lifted. As in the embodiment shown in FIG. 12, any mechanical linkage is not provided between the four turnout arrangements with no obstruction. Each of the turnout arrangements is provided with a crank shaft which is disposed in a position shown by $C_1$–$C_1$, $C_2$–$C_2$ or $C_3$–$C_3$ and has a central axis aligned with a point 0. Thus, the movable guide rails $A_1$ and $B_1$ are adapted to move linearly about the point 0 such that the right end of the movable guide rail $B_1$ will be moved in the direction of angle $\phi_1$ relative to the corresponding stationary guide rail while the left end thereof will be moved in the direction of angle $\phi_2$ thereto. Upon lowering, the movable guide rail $A_1$ is linearly moved about the point 0 so that it will take a position corresponding to the movable guide rail $A_3$ or $A_4$ shown by broken line. Furthermore, the movable guide rail $A_1$ can be actuated without any interference on the movable guide rail $B_1$ since the right end of the former is moved away from the right end of the latter.

The above three crank shafts are respectively provided with drive gear boxes 73, 74 and 75 which are connected with each other through drive shafts 76 and 77 each having cross joints at the opposite ends. Thus, the crank shafts can be rotated in synchronism with one another. Each of the drive gear boxes includes an electric motor the power of which is transmitted directly to the corresponding crank shaft to provide a torque required therein. However, torque parts produced by unbalanced resistance in operation are transmitted to the crank shaft through the drive shaft 76 and 77. Accordingly, the drive shafts need not have any large strength for torque. Each of the crank shafts is provided with a mechanical synchronization means by the use of the above drive shaft so that the electric motors can be couples in parallel or series to form a single control circuit as a whole.

Figure 14:
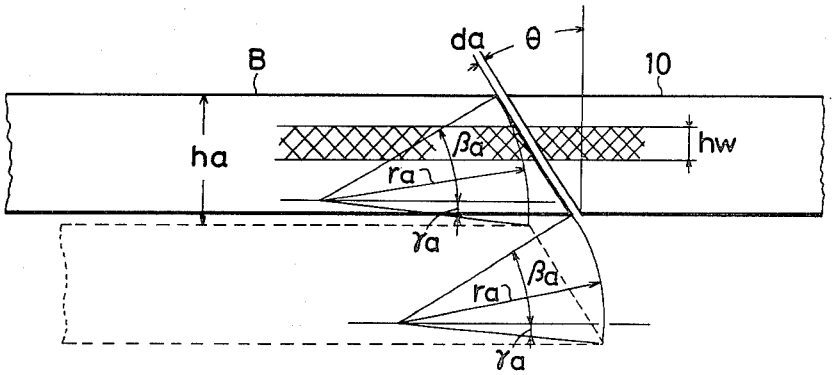
FIGS. 14, 15 and 16 are side views showing different embodiments of the present invention.
Figure 15:
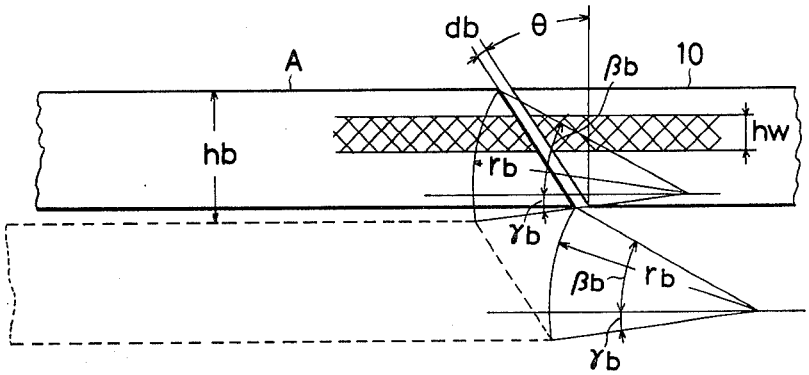
Figure 16:
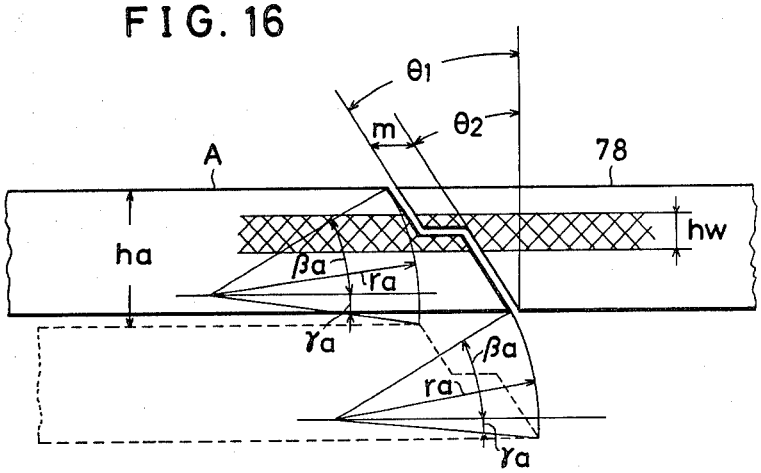

FIGS. 14, 15 and 16 illustrate different connections between the movable and stationary guide rails. FIG. 14 shows a relationship between the movable guide rail B and the stationary guide rail 10 in the embodiment of FIG. 6. The movable guide rail B is shown in its lifted position by solid line and positioned opposed to the stationary guide rail 10 with a gap da formed therebetween with an angle $\theta$. Upon lowering, the movable guide rail B is moved to a position shown by broken line. At this time, the movable guide rail B is lowered to describe an arc having a radius ra under the action of crank arms as described on FIG. 5. If the angle $\theta$ of the gap is equal to or more than the on-lighting-angle $\beta a$ of the crank arm, the gap da is increased as the movable guide rail is being lowered. Therefore, the movable guide rail will never contact with the stationary guide rail before or after the movement of the movable guide rail. It is however allowable that when lowered, the movable guide rail is moved to the stationary guide rail to decrease the gap da up to such a spacing which will never become zero. Therefore, it may practically be permitted that the slant angle $\theta$ is slightly smaller than the on-lifting-angle $\beta a$. In FIG. 14, a cross hatch portion having a width hw is a contact area on which the horizontal guide wheel 4 (FIG. 1 or 3) rolls.

FIG. 15 shows a relationship between the movable guide rail A and the stationary guide rail 10 in the embodiment of FIG. 6. In this case, the slant angle $\theta$ of the stationary guide rail 10 is determined based on the relationship between this stationary guide rail and the movable guide rail B in FIG. 14. The facing end of the movable guide rail A is correspondingly formed to define a gap db with the opposed end of the stationary guide rail 10 in the lifted position of the movable guide rail A shown by solid line. As in FIG. 5, the movable guide rail A is similarly lowered from the solid line position to the broken line position through an arc having a radius rb under the action of crank arms. However, the movement of this movable guide rail A is different from that of the movable guide rail B shown in FIG. 14 in that the movable guide rail A is further spaced away from the stationary guide rail 10 with no contact.

Symbol hw denotes the width of a contact area on which the horizontal guide wheel 4 runs as in FIG. 4. This intends that the gap between the adjacent guide rails has a slant angle $\theta$ to prolong a period of time required to cause the guide wheel to pass therethrough so that a shock will be damped to provide a smoother passage of the guide wheel through the gap. A ratio of passage time with a slant angle $\theta$ to passage time without it is represented by:

$$(da+hw\ \tan\theta) : da$$

It is thus understood that if it is desired to increase the advantage of the angle, it may be selected larger. If the angle is too large, however, the tip of the rail is more sharpened resulting in a problem in strength. The improvement of this problem is shown in FIG. 16 in which two gaps are connected with each other by a horizontal gap having a length of m within the contact area having a width hw so that the passage time of the guide wheel is more prolonged without any further sharpened tip of the guide rail. Thus, the guide wheel can more smoothly pass through the gap. Further, slant angle $\theta_1$ and $\theta_2$ are selected such that they are equal to or larger than the on-lifting-angle $\beta a$.

As described with reference to FIGS. 4 to 7, the turnout arrangement of guide track according to the present invention has an advantage in that there is no interference even if one of the movable guide rails is lowered while at the same time the other guide rail is lifted. The turnout arrangement according to the present invention is of a simplified construction with less movable parts in comparison with those of Utility Model Publication Nos. 47-43123 and 55-55281. Reversal of the switch can be at once completed and reduced in time since the vertical stroke is smaller. For the reason why the operation is at once effected, two crank arms can be mounted on a single crank shaft at the opposite ends as shown in FIG. 5. Since two movable guide rails having substantially the same length are equal to each other in weight, a pair of weights will be balanced relative to each other through the single crank shaft. However, there remains an unbalanced torque due to the angular position between the crank arms so that a driving torque transmitted to the crank shaft may be in such an extent that it opposes the above unbalanced torque. Accordingly, the power required to reverse the switch may be reduced to a relatively small value.

The turnout arrangement according to the present invention can broadly be applied not only to a guide track having guide rails on the opposite sides thereof, but also to a guide track including a guide rail which is located at the center of the track above or below a level including the top faces of running ways. Further, the present invention can easily be applied to a simple crossover or scissors crossover in a double track.

According to the present invention, furthermore, the drive means including an electric motor can be provided one for every turnout arrangement as shown in FIGS. 7 and 12. The drive means including an electric motor can also be provided one for every crank shaft as shown in FIG. 13. The number and position of the drive means can be advantageously selected in design depending on the length and weight of the movable guide rail used. If the drive means is one in number, it is of course that a single control circuit is used. Even if a plurality of drive means are used, a single control circuit can be used by connecting the electric motors in parallel or series since the electric motors are synchronously rotated by a mechanical means. Because the reversal of the switch is effected by a single operation only by reversing the rotation of the drive motor, the turnout arrangement can be controlled simply and be of a simplified construction.

Where movable guide rails are expanded and contracted due to the variation of ambient temperature, the expansion and contraction can be taken up by the slight swing of vertical extending links so that the reversal of switch can be accomplished without any undue affection. As shown in FIGS. 8 and 9, such an advantage can be obtained by the use of slide blocks as in the above links.

According to the present invention, further, time required to cause the horizontal guide wheels rolling along the sides of guide rail to pass through a gap between the adjacent guide rails can be prolonged to damp any shock thereon and to provide a smoother running of the guide wheels by forming a gap between the movable and stationary guide rails with an angle $\theta$ or a similar gap consisting of two gap sections of angle $\theta$ and a straight gap section of length m as shown in FIGS. 14, 15 and 16.

I claim:

1. A switching structure for a guideway track including running way means adapted for supporting running wheels of a guideway vehicle and guide rail means adapted for guiding guide wheels of said vehicle, said switching structure including a first and second moveable guide rail means, crank means for alternately raising and lowering the first and second movable guide rail means for switching running path of the vehicle, driving means for driving the crank means, said crank means having a first and second crankarms having a phase difference smaller that 180°, said first movable guide rail means being connected with said first crankarm at a first radius position so that the first movable guide rail means is movable substantially vertically for a first stroke when the first crankarm is rotated in an angular range which extends from a horizontal line, upwardly by a first upward angle and downwardly by a first downward angle which is smaller than said first upward angle, said second movable guide rail means being connected with said second crankarm at a second radius position so that the second movable guide rail means is movable substantially vertically for a second stroke when the second crankarm is rotated, in an angular range which extends from a horizontal line, upwardly by a second upward angle and downwardly by a second downward angle which is smaller than said second upward angle, said first and second strokes satisfying the following relationship, $$ha=ra(\sin\beta a+\sin\gamma a)$$

$$hb=rb(\sin\beta b+\sin\gamma b)$$

where:

ha and hb are the first and second strokes, respectively;

ra and rb are the first and second radius, respectively;

$\beta$a and $\beta$b are the first and second upward angles; and $\gamma$a and $\gamma$b are the first and second downward angles, said first and second movable guide rail means being shifted during their downward strokes horizontally by distances a and b, respectively, wherein the following relationships are established:

$$\delta a = ra(\cos \beta a - \cos \gamma a)$$

$$\delta b = rb(\cos \beta b - \cos \gamma b).$$

whereby said first and second movable guide rail means are shifted laterly outward when they are moved downward.

2. A switching structure in accordance with claim 1 in which said crank means includes at least two crankshafts which are disposed in parallel with each other.

3. A switching structure in accordance with claim 1 in which said crank means includes at least two crankshafts which are located substantially in alignment with normal lines with respect to centers of movements of the movable guide rail means.

4. A switching structure in accordance with claim 1 in which said crank means includes at least two crankshafts which are connected through connecting link means with each other so that they are synchronously operated.

5. A switching structure in accordance with claim 1 in which one of the crankarms is connected directly with one of the guide rail means and the other crankarm with the other guide rail means through substantially vertical link means.

6. A switching structure in accordance with claim 1 in which one of the crankarms is connected directly with one of the guide rail means and the other crankarm with the other guide rail means through substantially horizontally movable slide block means.

7. A switching structure in accordance with claim 1 in which said crankarms are connected with respective ones of the guide rail means through substantially horizontally movable slide block means, one of the slide block means being movable by a smaller distance than the other.

8. A switching structure in accordance with claim 1 in which said crank means includes at least two crankshafts having driven gear means engaged with driving gear means so that the crankshafts are synchronously driven.

9. A switching structure in accordance with claim 1 in which each of said movable guide rail is located so that it is opposed to an adjacent stationary guide rail with a substantially uniform gap when it is in a raised position.

* * * * *